US010004116B2

(12) United States Patent
Fukui et al.

(10) Patent No.: US 10,004,116 B2
(45) Date of Patent: Jun. 19, 2018

(54) LIGHTING DEVICE, HEADLIGHT DEVICE WITH THE SAME, AND VEHICLE

(71) Applicant: Panasonic Corporation, Osaka (JP)

(72) Inventors: Takahiro Fukui, Osaka (JP); Kazutoshi Suganuma, Niigata (JP); Toshifumi Tanaka, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 666 days.

(21) Appl. No.: 14/476,046

(22) Filed: Sep. 3, 2014

(65) Prior Publication Data

US 2015/0069907 A1 Mar. 12, 2015

(30) Foreign Application Priority Data

Sep. 10, 2013 (JP) ..... 2013-187582

(51) Int. Cl.
*H05B 37/02* (2006.01)
*H05B 33/08* (2006.01)

(52) U.S. Cl.
CPC ..... *H05B 33/0815* (2013.01)

(58) Field of Classification Search
CPC ..... H05B 33/0815; H05B 41/2828; H05B 33/0809; H05B 33/0851
USPC ..... 315/82, 307, 291
See application file for complete search history.

(56) References Cited

U.S. PATENT DOCUMENTS

2009/0115564 A1* 5/2009 Minteer ..... H01F 27/2804 336/84 M
2009/0174330 A1* 7/2009 Saveliev ..... H05B 41/2921 315/82
2011/0037416 A1 2/2011 Nakamura
2012/0287682 A1* 11/2012 Zhang ..... H02M 3/33507 363/21.16

FOREIGN PATENT DOCUMENTS

JP 2002-159176 A 5/2002
JP 2002159176 A * 5/2002
JP 2009-266599 A 11/2009
JP 2011-050126 A 3/2011
JP 2011-210659 A 10/2011
JP 2011-223800 A 11/2011

* cited by examiner

*Primary Examiner* — Douglas W Owens
*Assistant Examiner* — Amy Yang
(74) *Attorney, Agent, or Firm* — Renner, Otto, Boisselle & Sklar, LLP

(57) ABSTRACT

A lighting device includes a power converter and a controller. The power converter includes a transformer having primary, secondary and tertiary windings, and a switching device electrically connected in series with the primary winding. The controller is configured to measure a signal simulating a primary current flowing through the primary winding based on a voltage occurring across the tertiary winding and detect timing for turning the switching device off based on the signal simulating the primary current.

12 Claims, 8 Drawing Sheets

FIG. 1B

LIGHTING DEVICE, HEADLIGHT DEVICE WITH THE SAME, AND VEHICLE

CROSS REFERENCE TO RELATED APPLICATIONS

This application claims the benefit and priority of Japanese Patent Application No. 2013-187582, filed on Sep. 10, 2013, entitled "LIGHTING DEVICE, HEADLIGHT DEVICE WITH THE SAME, AND VEHICLE", the entire contents of which are incorporated herein by reference.

TECHNICAL FIELD

The disclosure relates to a lighting device configured to power a light source formed of one or more light-emitting devices such as one or more light-emitting diodes, a headlight device with the same, and a vehicle.

BACKGROUND ART

Conventionally, the number of vehicles with headlights changed from halogen lamps to HID (High Intensity Discharged) lamps was increased in order to improve visibility (improve brightness). Mass production of vehicles equipped with LED (light-emitting device) headlights has been started along with improvement in LED luminous efficiency in recent years. For example, JP Pub. No. 2011-050126 (hereinafter referred to as "Document 1") discloses a lighting device configured to power LEDs as headlight loads.

The lighting device described in Document 1 includes a DC/DC converter. The DC/DC converter includes an input terminal electrically connected to a DC power supply such as an in-vehicle battery and an output terminal electrically connected to the LEDs as loads, namely light sources.

The DC/DC converter includes an input capacitor electrically connected in parallel with an input connector of the lighting device. The input capacitor is electrically connected to a series circuit of a primary winding of a transformer and a switch device formed of an MOSFET. A secondary winding of the transformer is electrically connected to an output capacitor through a diode. When the switch device is turned on, a primary-side current (a drain current of the switch device) linearly increases and electromagnetic energy is stored in the transformer. When the switch device is then turned off, the diode is conducted by counter-electromotive force of the transformer and the energy stored in the transformer is discharged into the output capacitor.

The lighting device is provided with a primary-side current detecting circuit. When the switch device is turned on, a voltage proportional to the primary-side current occurs at a drain terminal of the switch device. The primary-side current detecting circuit is configured to detect the voltage to output it as a primary-side current detection value. The primary-side current detecting circuit monitors a drain voltage of the switch device when it is turned off, and determines discharge timing of the energy stored in the transformer by detecting timing when the drain voltage decreases. A detection result thereof is transmitted to a microcomputer as a secondary-side current discharge signal.

When receiving the secondary-side current discharge signal, the microcomputer turns the switch device on. When the primary-side current detection value reaches a primary-side current command value, the microcomputer turns the switch device off. By repeating the aforementioned operations, the microcomputer controls the switch device at a boundary current mode.

There has recently been a decreasing trend in an output voltage of a DC/DC converter when powering LEDs along with realization of LEDs with high efficiency, designed for high-current operation. The output voltage of the DC/DC converter needs to be decreased in a case where a part of LEDs constituting a load breaks down and remaining LEDs are still operated. The switch device is generally selected from switch devices each of which has on-resistance as small as possible in order to reduce loss of circuit.

In the lighting device, the primary-side current detection value is however to have a small value if a switch device having a small on-resistance is used in a case where an output of the DC/DC converter is a low output voltage. There is therefore a concern that the lighting device cannot stably control an output current thereof because the primary-side current detection value has a small variation range, so that the turn-off timing of the switch device cannot be accurately detected.

SUMMARY OF THE INVENTION

The present invention has been achieved in view of the above circumstances, and an object thereof is to enable a stable control of an output current even in a case of a low output voltage.

A lighting device in an aspect of the present invention includes a power converter and a controller. The power converter includes a transformer including primary and secondary windings on input and output sides thereof, respectively, and a switching device that is electrically connected in series with the primary winding. The power converter is configured to perform conversion of a power supply voltage from a DC power supply to supply an output obtained by the conversion to a load formed of one or more light-emitting devices. The controller is configured to control ON and OFF of the switching device so as to adjust the output of the power converter. The transformer further includes a tertiary winding different from the secondary winding on the output side. The controller is configured to measure a signal simulating a primary current flowing through the primary winding based on a voltage occurring across the tertiary winding and detect timing for turning the switching device off based on the signal simulating the primary current.

A headlight device in an aspect of the present invention includes the lighting device, the load and a housing that houses the load.

A vehicle in an aspect of the present invention includes a headlight device that includes a load formed of one or more light-emitting devices, a housing that houses the load, and a lighting device. The lighting device comprises a power converter and a controller. The power converter includes a transformer and a switching device. The transformer includes primary and secondary windings on input and output sides thereof, respectively. The switching device is electrically connected in series with the primary winding. The power converter is configured to perform conversion of a power supply voltage from a DC power supply to supply an output obtained by the conversion to a load formed of one or more light-emitting devices. The controller is configured to control ON and OFF of the switching device so as to adjust the output of the power converter. The transformer further includes a tertiary winding different from the secondary winding on the output side. The controller is configured to measure a signal simulating a primary current flowing through the primary winding based on a voltage occurring across the tertiary winding and detect timing for turning the switching device off based on the signal simulating the primary current.

According to the aspects of the present invention, a signal simulating a primary current is to be measured based on a voltage occurring across the tertiary winding. It is accordingly possible to voluntarily set a measurement range of the voltage occurring across the tertiary winding that simulates the primary current regardless of variation amount of the voltage occurring across the switching device. Measurement resolution of the primary current can be increased in comparison with the lighting device described in Document 1. In addition, the timing for turning the switching device off can be accurately detected. A stable control of an output current of the lighting device can be consequently enabled even if an output of the lighting device is a low output voltage.

BRIEF DESCRIPTION OF THE DRAWINGS

The figures depict one or more implementations in accordance with the present teaching, by way of example only, not bay way of limitations. In the figure, like reference numerals refer to the same or similar elements where.

DETAILED DESCRIPTION

Figure 1A:
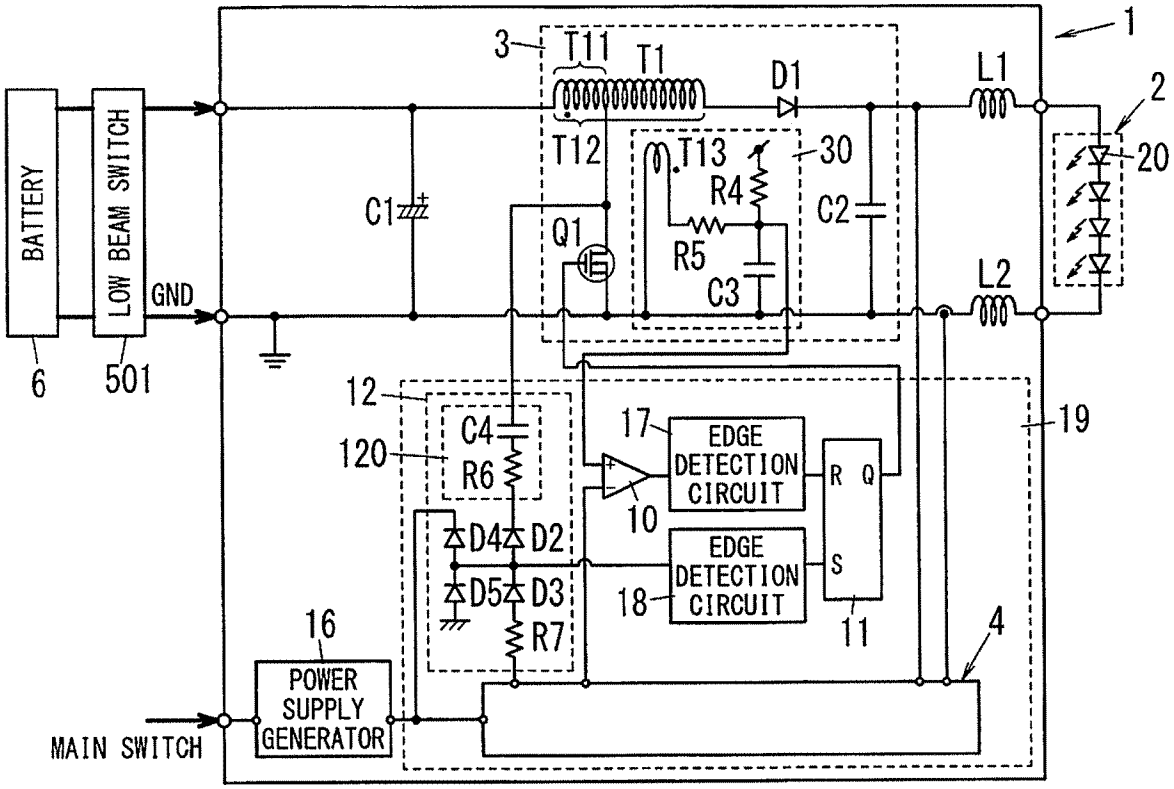
FIG. 1A is a circuit diagram of a lighting device in accordance with an embodiment of the present invention.

As shown in FIG. 1A, a lighting device 1 in an embodiment includes a power converter 3 and a controller 19. The power converter 3 is configured to perform conversion of a power supply voltage from a battery (a DC power supply) 6 to supply a load 2 with an output (an output signal) obtained by the conversion. The load 2 is formed of one or more LEDs (light-emitting devices) 20. The controller 19 is configured to control ON and OFF of a switching device Q1 so as to adjust the output (an output signal level) of the power converter 3. In an example, the power converter 3 is configured to perform conversion of the power supply voltage from the battery 6 so that an output current to the load 2 becomes constant, and then to supply the load 2 with the output (a constant output current) obtained by the conversion.

The power converter 3 includes a transformer T1 and the switching device Q1. The transformer T1 includes a primary winding T11 on an input side thereof and a secondary winding T12 on an output side thereof. The switching device Q1 is electrically connected in series with the primary winding T11 and configured to be turned on and off through the controller 19. The transformer T1 further includes a tertiary winding T13 different from the secondary winding T12 on the output side.

The controller 19 is configured to measure a signal simulating a primary current flowing through the primary winding T11 based on a voltage occurring across the tertiary winding T13, and detect timing for turning the switching device Q1 off based on the signal simulating the primary current.

Figure 2:
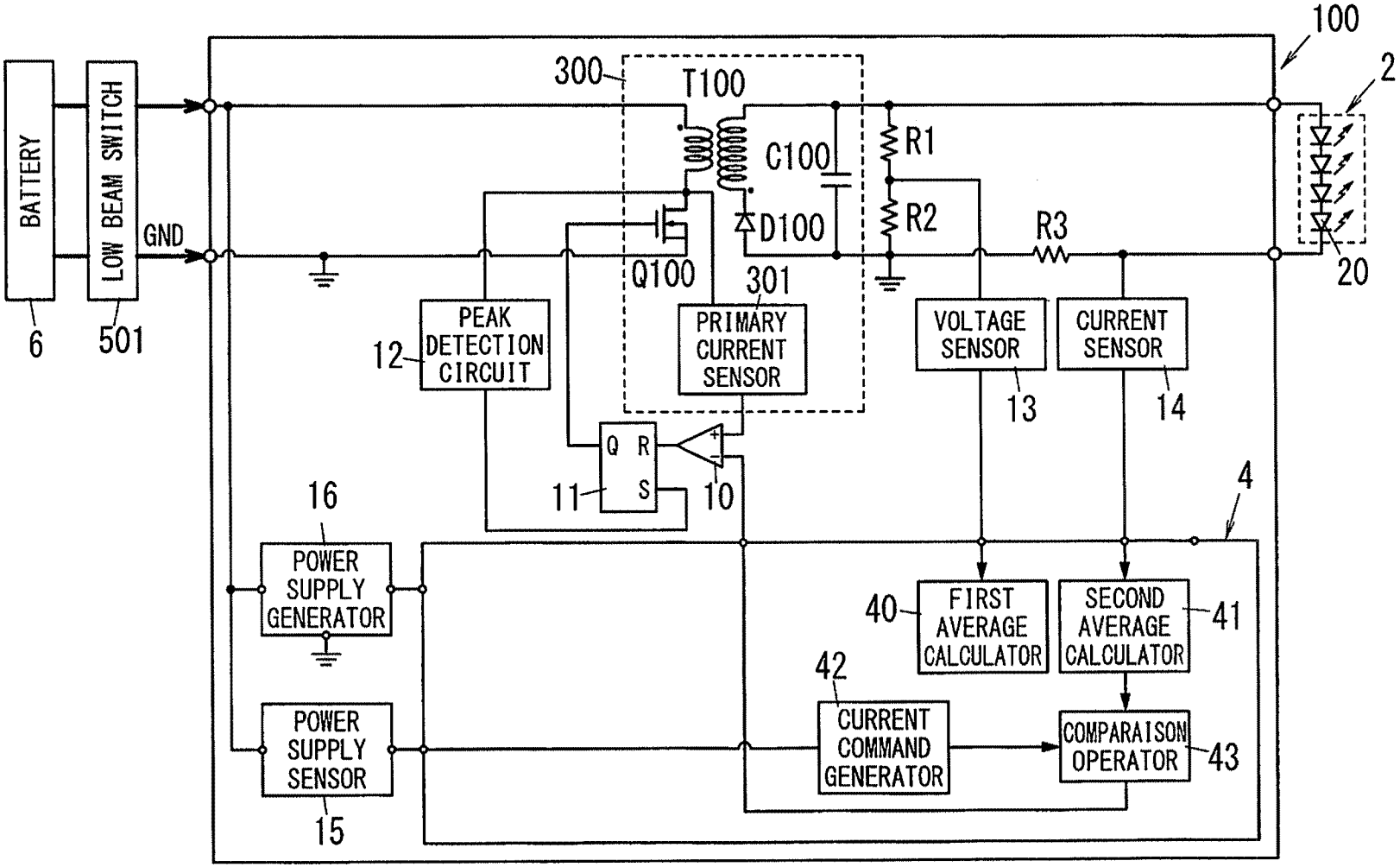
FIG. 2 is a circuit diagram of a lighting device in a comparison example.

A lighting device in a comparison example is first explained with reference to figures. As shown in FIG. 2, a lighting device 100 in the comparison example is configured to power (operate) a load 2 by applying a DC voltage across the load 2. The load 2 is formed of two or more (four in the figure) LEDs (light-emitting devices) 20 which are electrically connected in series with each other. It is assumed that two or more (e.g., two) lighting device 100 are installed in a vehicle such as a car and two or more (e.g., two) load 2 are employed as low beam headlight devices (see FIG. 9).

As shown in FIG. 2, the lighting device 100 includes a power converter 300 formed of a flyback DC/DC converter. The power converter 300 is electrically connected to a battery 6 that is a DC power supply, and configured to convert a DC power supply voltage applied from the battery 6 into an increased or decreased DC voltage by which the load 2 can be lit.

Figure 9:
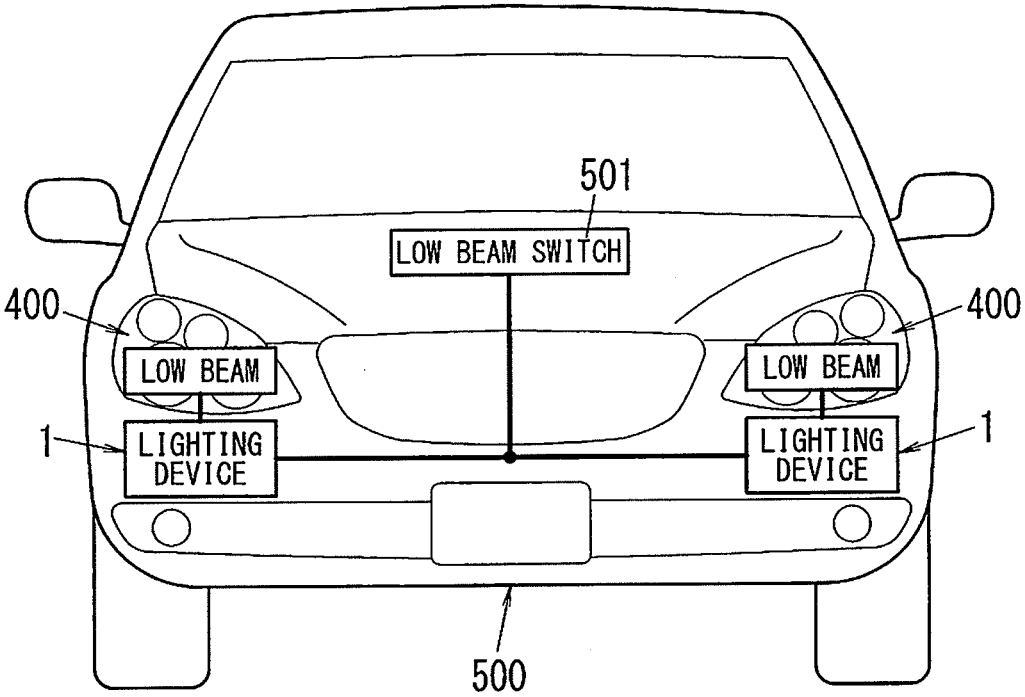
FIG. 9 illustrates a vehicle in accordance with an embodiment of the present invention.

The power converter 300 is also configured to be supplied with a power supply voltage from the battery 6 through a low beam switch 501 (see FIG. 9). That is, when the low beam switch 501 is turned on, the power supply voltage is supplied from the battery 6 to the power converters 300. When the low beam switch 501 is turned off, it stops supply of the power supply voltage from the battery 6 to the power converters 300.

The power converter 300 includes a transformer T100, a switching device Q100, a diode D100 and a capacitor C100. The switching device Q100 is electrically connected in series with a primary winding of the transformer T100. The capacitor C100 is electrically connected between both ends of a secondary winding of the transformer T100 via the diode D100. The switching device Q100 is formed of an N-channel MOSFET. The battery 6 is electrically connected to a series circuit of the primary winding of the transformer T100 and the switching device Q100 through the low beam switch 501. Therefore, when the switching device Q100 is turned on and off, an electric current flows through the capacitor C100 via the diode D100 from the secondary winding of the transformer T100, and a DC voltage occurs across the capacitor C100.

An operation of the power converter 300 in FIG. 2 is now explained. When the switching device Q100 is turned on, an electric current flows through the primary winding of the transformer T100 and energy is stored therein. Accordingly, a voltage between a drain and a source of the switching device Q100 (referred to as a "drain voltage") rises. In the comparison example, the power converter 300 further includes a primary current sensor 301 configured to measure a primary current flowing through the primary winding of the transformer T100. The primary current sensor 301 is also configured to supply the drain voltage of the switching device Q100 to a comparator 10.

The comparator 10 is configured to compare an output value (a value of the drain voltage) of the primary current sensor 301 and a control value from a comparison operator (a comparison arithmetic unit) 43 in a microcomputer 4 to be described later. An output (an output signal) of the comparator 10 is to be supplied to a reset (R) terminal of an RS flip-flop circuit 11. When the output value of the primary current sensor 301 exceeds the control value from the comparison operator 43, the reset terminal of the RS flip-flop circuit 11 is supplied with "1". The output (the output signal) of the RS flip-flop circuit 11 then becomes "0" and the switching device Q100 is tuned off.

When the switching device Q100 is tuned off, the energy stored in the primary winding of the transformer T100 is discharged into the secondary side thereof. After the energy discharge is finished, the drain voltage of the switching device Q100 decreases. The decrease in the drain voltage is detected with a peak detection circuit 12 formed of a differentiating circuit. A set (S) terminal of the RS flip-flop circuit 11 is supplied with "1" by the output (the output signal) of the peak detection circuit 12. As a result, the output (the output signal) of the RS flip-flop circuit 11 becomes "1" and the switching device Q100 is turned on again. Thus, the power converter 300 is controlled at a boundary current mode. That is, the switching device Q100 of the power converter 300 is turned on at a point in time at which energy discharge from the transformer T100 is finished.

Normally, the lighting device 100 operates the load 2 in accordance with constant current control for controlling so that an electric current flowing though the load 2 is kept constant. The microcomputer 4 is used for the control. The lighting device 100 further includes a voltage sensor 13 and a current sensor 14. The voltage sensor 13 is configured to measure a voltage applied across the load 2 as an output voltage of the lighting device 100. The current sensor 14 is configured to measure an electric current flowing through the load 2 as an output current of the lighting device 100. In the example of FIG. 2, the voltage sensor 13 is configured to measure the output voltage of the lighting device 100 from a voltage obtained by dividing the output voltage of the power converter 300 by resistors R1 and R2 electrically connected in series between output ends of the power converter 300. The current sensor 14 is configured to measure the output current from a voltage across a resistor R3 intervened between the power converter 300 and the load 2.

The microcomputer 4 further includes functions of a first average calculator 40, a second average calculator 41 and a current command generator (a current command unit) 42 in addition to the aforementioned comparison operator 43. The first average calculator 40 is configured to average the output voltage (output voltage values) obtained through the voltage sensor 13. The second average calculator 41 is configured to average the output current (output current values) obtained by the current sensor 14. The comparison operator 43 is configured to obtain a current command value (hereinafter referred to an "adjustable current command value") from the current command generator 42. The current command generator 42 (the microcomputer 4) previously stores a specified current command value. The current command generator 42 is configured to obtain the adjustable current command value from the specified current command value and a DC voltage value from a power supply sensor 15 and then to supply the adjustable current command value to the comparison operator 43. The power supply sensor 15 is electrically connected to the battery 6 via the low beam switch 501, and configured to measure a DC voltage (the power supply voltage) of the battery 6 to supply a DC voltage value to the current command generator 42. The specified current command value is a value that is set with respect to a predetermined DC voltage value (power supply voltage) of DC voltage values to be obtained from the power supply sensor 15. Therefore, in order to supply the load 2 with a constant output current, the current command value (the adjustable current command value) needs to be corrected in response to the specified current command value and a DC voltage value obtained from the power supply sensor 15. The current command generator 42 is accordingly configured to correct or maintain the specified current command value based on a DC voltage value (a power supply voltage) measured through the power supply sensor 15, thereby determining the current command value (the adjustable current command value).

The comparison operator 43 in the microcomputer 4 then compares the adjustable current command value and an average value of the output current. The comparison operator 43 then supplies the comparator 10 with a control value for controlling the power converter 300 so that both values coincide with each other. The power converter 300 is consequently driven in accordance with constant current control so that the output current of the lighting device 100 is equal to the adjustable constant current command value for a constant output current.

The microcomputer 4 also has a function (not shown) configured to average the power supply voltage (power supply voltage values) obtained through the power supply sensor 15. The microcomputer 4 is activated by an operation voltage supplied from a power supply generator 16. The power supply generator 16 is electrically connected to the battery 6 via not the low beam switch 501 but a main switch, and configured to generate the operation voltage for the microcomputer 4 from the DC voltage supplied from the battery 6.

Figure 3:
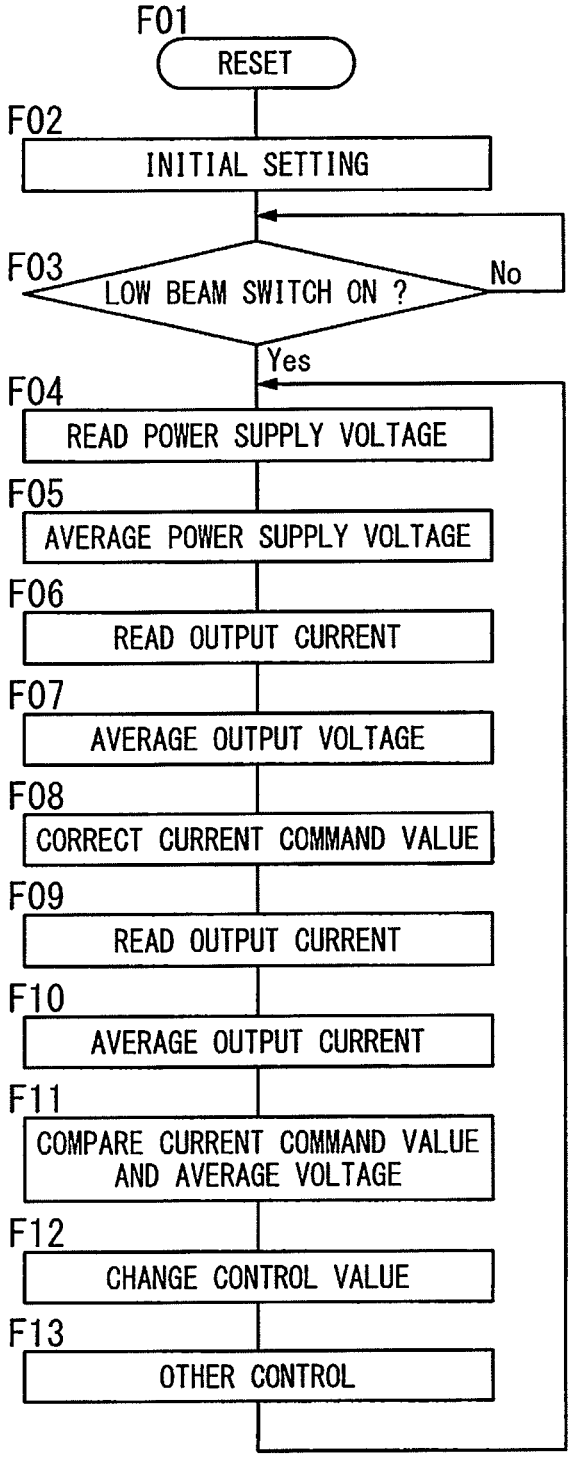
FIG. 3 is a flow chart depicting lighting control by a microcomputer of the lighting device in the comparison example.

A flow of lighting control by the microcomputer 4 is now explained with reference to FIG. 3. When the microcomputer 4 is first activated by turning the main switch on, the microcomputer 4 is reset (F01) and the microcomputer 4 initializes variables, flags and the like to be used (F02). The microcomputer 4 then judges whether or not the low beam switch 501 is turned on (F03). When the low beam switch 501 is turned on, the microcomputer 4 proceeds to a loop for activating the load 2 (see F04 to F13). Specifically, in cases of FIGS. 1A, 5, 6A and 7, the microcomputer 4 is activated by turning the main switch on. On the other hand, in a case of FIG. 2, the power supply sensor 15 is further provided, and the microcomputer 4 is activated by turning the low beam switch 501 on. In this example of FIG. 2, the microcomputer 4 is configured to compare a voltage measured through the power supply sensor 15 with a threshold voltage higher than a minimum operating voltage of the microcomputer 4. The microcomputer 4 is also configured to determine that the low beam switch 501 is turned on if the voltage measured through the power supply sensor 15 is higher than the threshold voltage.

When activating the load 2, the microcomputer 4 obtains a power supply voltage (a power supply voltage value) via an A/D converter (F04) to average the power supply voltage value along with previously obtained power supply voltage values (F05). In an example, whenever obtaining a current power supply voltage value (a measurement value), the microcomputer 4 stores the current power supply voltage value along with two or more (e.g., two) power supply voltage values before the current power supply voltage value, and also before storing the current power supply voltage, the microcomputer 4 averages the current power supply voltage value along with two or more (e.g., three) power supply voltage values stored before the current power supply voltage.

The microcomputer 4 then obtains an output voltage (an output voltage value) of the power converter 300 via an A/D converter (F06) to average the output voltage value along with previously obtained output voltage values like the aforementioned power supply voltage (F07). The microcomputer 4 then reads out a specified current command value stored in an internal ROM (not shown) to correct or maintain the specified current command value as an adjustable current command value based on an average value of the power supply voltage values (F08). The microcomputer 4 further obtains an output current (an output current value) of the power converter 300 via an A/D converter (F09) to average the output current value along with previously obtained output current values like the aforementioned power supply voltage (F10).

The microcomputer 4 then compares the adjustable current command value and an average of the output current values (F11) to change or maintain a control value based on the compared result (F12). The microcomputer 4 then performs other control for judging malfunction of the load 2, malfunction of the power supply or the like (F13).

Figure 4A:
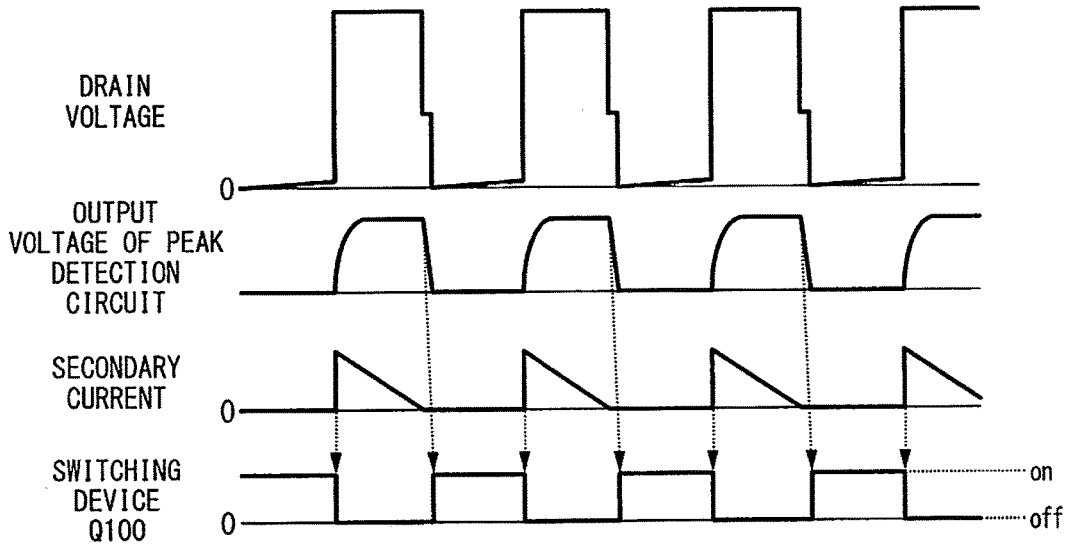
FIGS. 4A to 4D are views illustrating problems of the lighting device in the comparison example.
Figure 4B:
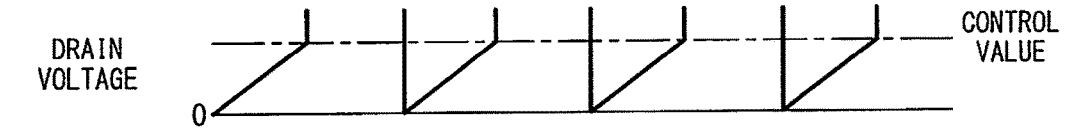

FIG. 4A shows waveforms of the drain voltage of the switching device Q100, the output voltage of the peak detection circuit 12, the secondary current of the transformer T100, and switching of the switching device Q100 in a case where the load 2 is lit according to the above-mentioned lighting control. FIG. 4B shows a partially enlarged view of the waveform of the drain voltage of the switching device Q100.

In each on-period of the switching device Q100, a drain voltage is generated between the drain and the source thereof, where the drain voltage corresponds to a multiplied value of a drain current and an on-resistance of the switching device Q100. In each on-period, the drain current continues to increase and accordingly the drain voltage also continues to increase as shown in FIG. 4B. When the drain voltage of the switching device Q100 reaches the control value from the microcomputer 4, the switching device Q100 is turned off. In this case, the drain voltage of the switching device Q100 increases up to Vin+Vout/n, where Vin is an input voltage of the power converter 300, Vout is an output voltage of the power converter 300, and 1/n is a turn ratio of the transformer T100.

In each off-period of the switching device Q100, a secondary current is discharged via the diode D100. When the discharge of the secondary current is finished (the current reaches zero), the drain voltage of the switching device Q100 decreases from Vin+Vout/n to Vin. The peak detection circuit 12 detects decrease in the drain voltage, and the switching device Q100 is turned on by the detected timing. By repeating the aforementioned operations, the lighting device 100 controls the power converter 300 at the boundary current mode. That is, the switching device Q100 of the power converter 300 is turned on at a point in time at which energy discharge from the transformer T100 is finished.

As described in "BACKGROUND ART", an output voltage of the power converter 300 when powering the load 2 has a decreasing trend along with realization of LEDs with high efficiency, designed for high-current operation. For example, if the load 2 is a headlight device for low beam, two or more LED chips of each of which forward voltage is in a range of approximately 2 to 4V (rated current is in a range of approximately 1 to 1.5 A) are used as mainstream. The power converter 300 needs to be considered that the output voltage thereof becomes substantially several volts in a case where a part of LEDs 20 constituting a load 2 breaks down and only one LED 20 is still operated.

The switching device Q100 is generally selected from switching devices each of which has on-resistance as small as possible in order to reduce loss of circuit. For example, if the load 2 is a low beam headlight, the switching device Q100 is generally selected from devices of which maximum rated voltage between a drain and a source thereof is in a range of approximately 30 to 60V, and of which on-resistance is in a range of approximately several mΩ to 10 mΩ.

Figure 4C:
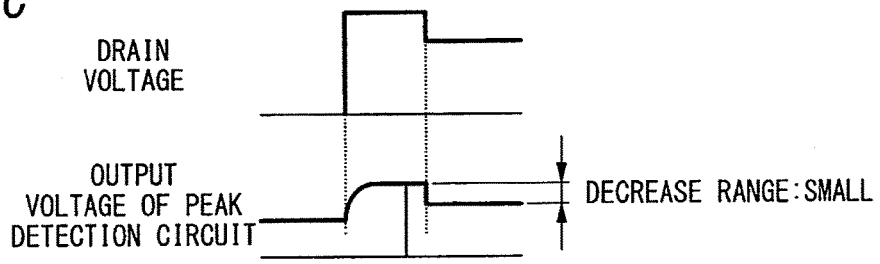

Thus, if the power converter 300 has a low output voltage and the switching device Q100 has a small on-resistance, the drain voltage of switching device Q100 in proportion to the primary current has a small variation range as shown in FIG. 4C. The microcomputer 4 accordingly needs to set the control value to a small value. As a result, measurement resolution of the primary current becomes small, and timing for turning the switching device Q100 off cannot be accurately detected. In this case, there is a concern that an output current of the power converter 300 cannot be stably controlled.

A lighting device 1 of an embodiment in order to solve the problem is explained with reference to FIGS. 1A and 1B. Like kind elements are assigned the same reference numerals as depicted in the lighting device 100 and are not described in detail herein. A flow of lighting control by a microcomputer 4 in the lighting device 1 of the embodiment is the same as that in the lighting device 100, and is not described herein. Resistors R1 to R3, a voltage sensor 13, a current sensor 14 and a power supply sensor 15 in the embodiment are not shown in FIG. 1A. In addition, a first average calculator 40, a second average calculator 41, a current command generator 42 and a comparison operator 43 in the microcomputer 4 are not shown in FIG. 1A.

As shown in FIG. 1A, the lighting device 1 of the embodiment is provided with a power converter 3 in place of the power converter 300. A noise filter (e.g., two coils L1 and L2) is provided between the power converter 3 and a load 2. In the lighting device 1 of the embodiment, a peak detection circuit 12 is formed of a differentiating circuit 120, diodes D2-D5 and a resistor R7. The differentiating circuit 120 is formed of a series circuit of a capacitor C4 and a resistor R6. The lighting device 1 of the embodiment is further provided with an (first) edge detection circuit 17 between an RS flip-flop circuit 11 and a comparator 10, and an (second) edge detection circuit 18 between the RS flip-flop circuit 11 and the peak detection circuit 12.

The lighting device 1 of the embodiment is further provided with a controller 19 that is formed of the comparator 10, the RS flip-flop circuit 11, the peak detection circuit 12, the edge detection circuits 17 and 18, and a microcomputer (a processor) 4. The controller 19 is configured to detect timing for turning on a switching device Q1 at a point in time at which energy discharge from the transformer T1 is finished, based on variation of a voltage occurring across a switching device Q1 (a drain voltage thereof in the embodiment), and then to control the power converter 3 at a boundary current mode. That is, the switching device Q1 of the power converter 3 is turned on in accordance with the timing.

The power converter 3 includes a transformer T1, the switching device Q1, a diode D1 and a capacitor C2. The transformer T1 is formed of an autotransformer. The switching device Q1 is electrically connected in series with a primary winding T11 of the transformer T1. The capacitor C2 is electrically connected to a secondary winding T12 of the transformer T1 via the diode D1. The switching device Q1 is formed of an N-channel MOSFET. A series circuit of the primary winding T11 of the transformer T1 and the switching device Q1 is electrically connected to a battery 6 via a smoothing capacitor C1 (specifically, via the smoothing capacitor C1 and a low beam switch 501). Therefore, when the switching device Q1 is turned on and off, an electric current is supplied to the capacitor C2 via the diode D1 from the secondary winding T12 of the transformer T1. As a result, a DC voltage is generated across the capacitor C2. The capacitor C2 (an output capacitor) supplies the load 2 with the DC voltage occurring across the capacitor, thereby supplying electric power to the load 2.

The power converter 3 is provided with a primary current sensor 30 that is configured to substantially measure a primary current flowing through the primary winding T11 of the transformer T1. The primary current sensor 30 includes a tertiary winding T13 that is wound around a magnetic body (not shown) of the transformer T1. One end (a first end) of the tertiary winding T13 is electrically connected to GND (ground) and supplied with ground potential. Other end (a second end) of the tertiary winding T13 is electrically connected to a series circuit that is formed of a resistor R5 and a capacitor C3 and electrically connected between the second end and GND. A control power supply of, e.g., 5V is electrically connected to a junction of the resistor R5 and the capacitor C3 through the resistor R4, and configured to supply a DC voltage to the junction therethrough. In the lighting device 1 of the embodiment, the control power supply is formed of a power supply generator 16.

The peak detection circuit 12 is configured to detect a decrease (a fall) in a drain voltage of the switching device Q1. The differentiating circuit 120 is provided between a drain of the switching device Q1 and a series circuit of the diodes D2 and D3 and the resistor R7. The microcomputer 4 is configured to supply a DC voltage to an anode of the diode D3 via the resistor R7. The microcomputer 4 is configured to supply the DC voltage when the switching device Q1 is turned off, and stop supplying the DC voltage when the switching device Q1 is turned on.

A junction of an anode of the diode D2 and a cathode of the diode D3 is electrically connected to the edge detection circuit 18, an anode of the diode D4 and a cathode of the diode D5. A series circuit of the diodes D4 and D5 is provided between the power supply generator 16 and GND, and configured to limit an output voltage of the peak detection circuit 12 within a range between 0V and an output voltage of the power supply generator 16 (5V in the embodiment).

An operation of the peak detection circuit 12 is briefly explained. When the switching device Q1 is in off-state, a DC voltage supplied from the microcomputer 4 becomes an output voltage of the peak detection circuit 12 until discharge of a secondary current flowing through the secondary winding T12 of the transformer T1 is finished. If the drain voltage of the switching device Q1 decreases after the discharge of the secondary current is finished, the DC voltage supplied from the microcomputer 4 is pulled out via the diode D2. As a result, the output voltage of the peak detection circuit 12 decreases.

The edge detection circuit 17 is configured to detect a rising edge of an output voltage of the comparator 10. The edge detection circuit 18 is configured to detect a trailing edge of the output voltage of the peak detection circuit 12.

In the embodiment, the capacitor C3 of the primary current sensor 30 is configured to be charged when the switching device Q1 is in on-state and to be discharged when the switching device Q1 is in off-state. As shown in FIG. 1B, the output voltage of the primary current sensor 30 corresponds to a voltage obtained by superposing an offset voltage V1 on a voltage across the capacitor C3 that varies according to discharge and charge. The offset voltage V1 is obtained by dividing the DC voltage of the control power supply (the power supply generator 16) by the resistors R4 and R5.

That is, in order to substantially measure the primary current, the lighting device 1 of the embodiment is to measure a charging voltage of the capacitor C3 on a secondary side of the transformer T1 in the power converter 3 because the charging voltage of the capacitor C3 simulates the primary current flowing through the primary winding T11 of the transformer T1. In short, the lighting device 1 is configured to measure the charging voltage of the capacitor C3 that simulates the primary current. A range of an output voltage of the primary current sensor 30 can be adjusted by changing a turn ratio of the tertiary winding T13, a resistance value of the resistor R5 and a capacitance value of the capacitor C3. It is desirable that the tertiary winding T13 be set to a minimum turn ratio for securing a voltage required for measurement of the primary current in order to avoid increasing in circuit size caused by high breakdown voltage component selection. The offset voltage V1 can be adjusted by changing resistance values of the resistors R4 and R5. In the lighting device 1 of the embodiment, the primary current can be stably measured because the first end of the tertiary winding T13 is electrically connected to GND.

As described above, in the lighting device 1 of the embodiment, the primary current sensor 30 is to substantially measure the primary current by simulating the primary current based on a voltage occurring across the tertiary winding T13. In the lighting device 1 of the embodiment, a measurement range of the voltage occurring across the tertiary winding T13 that simulates the primary current can be voluntarily set regardless of variation amount of the drain voltage of the switching device Q1 during on-period thereof. In the lighting device 1 of the embodiment, it is therefore possible to enhance measurement resolution of the primary current and to accurately detect timing for turning off the switching device Q1 in comparison with the lighting device 100. As a result, in the lighting device 1 of the embodiment, the output current can be stably controlled even if the power converter 3 has a low output voltage.

In comparison with the lighting device 100, the lighting device 1 of the embodiment can also secure resolution required for measurement of the primary current even when the drain voltage of the switching device Q1 contains a small variation amount during on-period thereof. In the lighting device 1 of the embodiment, it is therefore possible to employ the switching device Q1 having a small on-resistance and to reduce loss of circuit. The primary current sensor 30 can be realized by providing the transformer T1 with the tertiary winding T13. Therefore, the configuration of the power converter 3 can be applied to other configuration of DC/DC converter, and is not limited to the configuration of the lighting device 1 of the embodiment.

Figure 5:
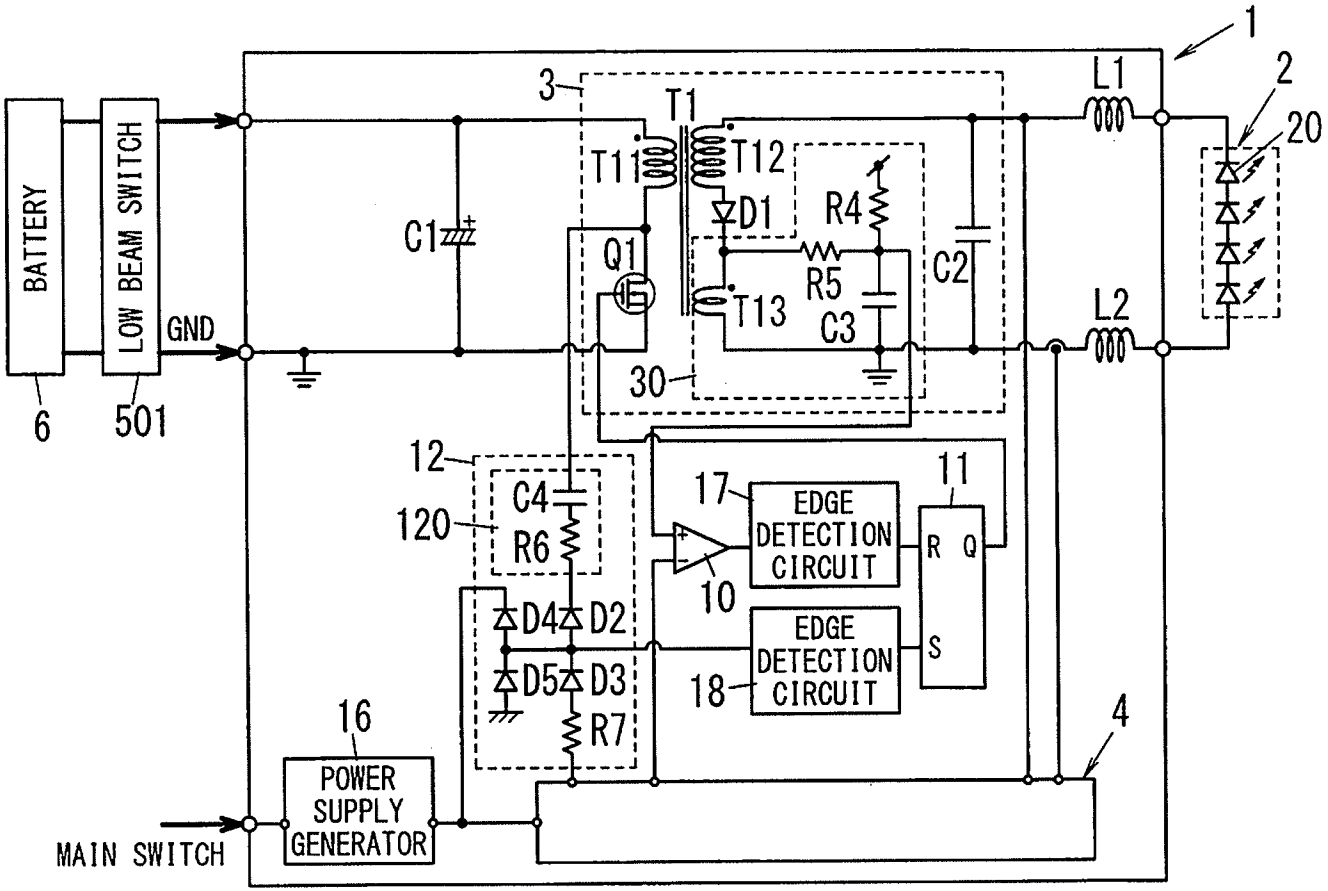
FIG. 5 is a circuit diagram of a lighting device in accordance with an embodiment of the present invention.

A lighting device 1 of an embodiment is explained with reference to FIG. 5. A basic configuration of the lighting device 1 in the embodiment is the same as that of the lighting device 1 shown in FIGS. 1A and 1B, and like kind elements are assigned the same reference numerals as depicted in FIGS. 1A and 1B and are not described in detail herein. In the lighting device 1 of the embodiment, a transformer T1 of a power converter 3 is formed of a double-winding transformer in which primary and secondary windings T11 and T12 are electrically insulated from each other as shown in FIG. 5. In the lighting device 1 of the embodiment, the secondary winding T12 of the transformer T1 is wound in a direction opposite to that in the embodiment of FIGS. 1A and 1B. Therefore, each LED 20 in the load 2 is electrically connected in a direction opposite to that in the embodiment of FIGS. 1A and 1B because an output voltage of the power converter 3 has polarity opposite to that of the embodiment of FIGS. 1A and 1B.

In the lighting device 1 of the embodiment, a part of the secondary winding T12 (specifically, a part of a coil forming the secondary winding T12) is employed as a tertiary winding T13, and a diode D1 is provided between the secondary winding T12 and the tertiary winding T13. The diode D1 is arranged so as to prevent an electric current from flowing through the secondary and tertiary windings T12 and T13 when a switching device Q1 is turned on. One end (a first end) of the tertiary winding T13 is electrically connected to GND and supplied with ground potential. Other end (a second end) of the tertiary winding T13 is electrically connected to a series circuit that is formed of a resistor R5 and a capacitor C3, and electrically connected between the second end and GND. A control power supply (a power supply generator 16) is electrically connected to a junction of a resistor R5 and a capacitor C3 through a resistor R4, and configured to supply a DC voltage to the junction therethrough.

Figure 1B:
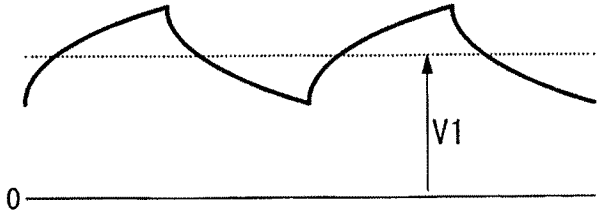
FIG. 1B illustrates a waveform of an output voltage from a primary current sensor.

The lighting device 1 of the embodiment can exhibit the same advantages as those of the lighting device 1 of FIGS. 1A and 1B. In the lighting device 1 of the embodiment, a part of the secondary winding 12 (specifically, a part of a coil forming the secondary winding T12) is employed as the tertiary winding T13. Therefore, in the lighting device 1 of the embodiment, the transformer T1 can be downsized in comparison with the lighting device 1 of FIGS. 1A and 1B in which the tertiary winding T13 is separately provided.

The lighting device 1 of the embodiment is configured to power the load 2 formed of the LEDs 20, but may be configured to power a load 2 formed of, for example, an HID lamp. In this case, the same advantages described above can be exhibited.

Figure 6A:
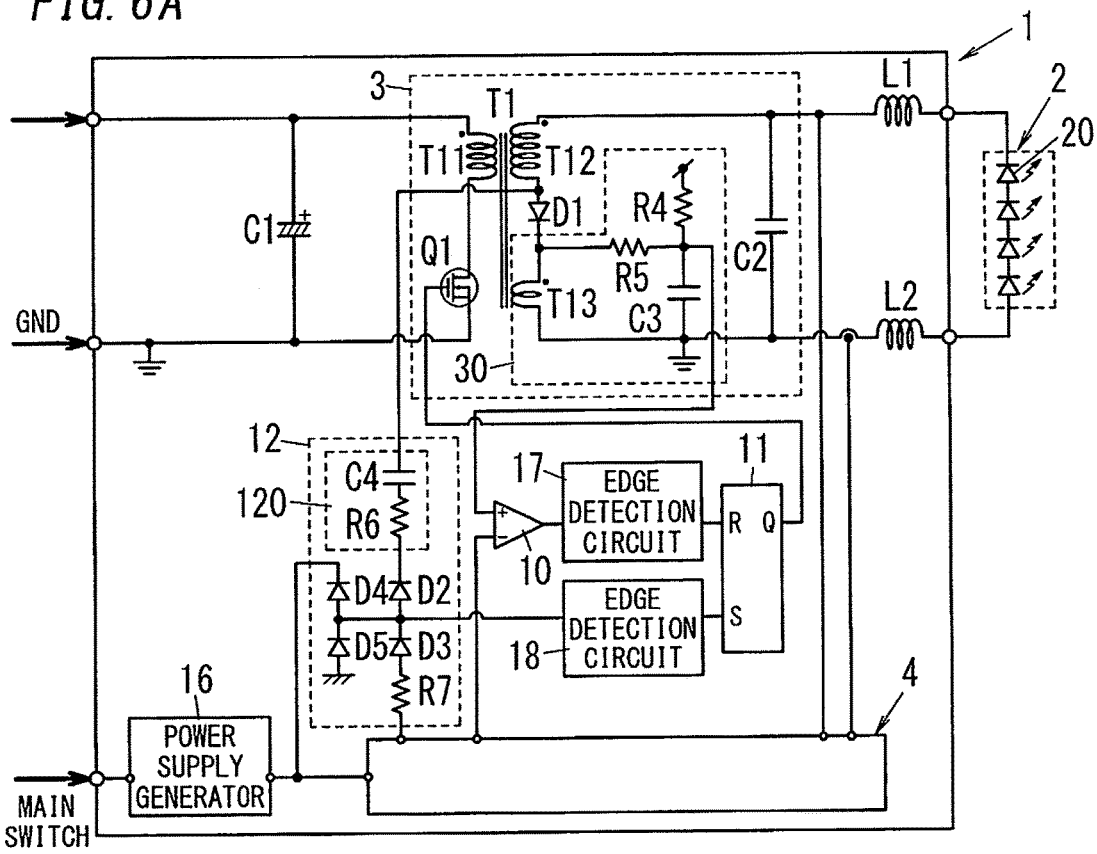
FIG. 6A is a circuit diagram of a lighting device in accordance with an embodiment of the present invention.
Figure 6B:
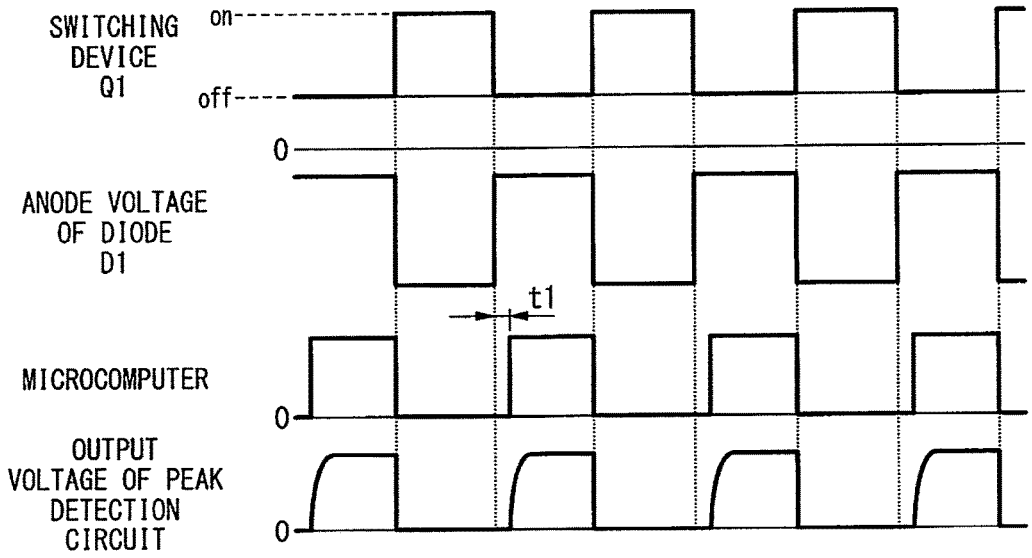
FIG. 6B illustrates operational waveforms thereof.

A lighting device 1 of an embodiment is explained with reference to FIGS. 6A and 6B. A basic configuration of the lighting device 1 in the embodiment is the same as that of the lighting device 1 shown in FIG. 5, and like kind elements are assigned the same reference numerals as depicted in FIG. 5 and are not described in detail herein. In the lighting device 1 of the embodiment, a differentiating circuit 120 is electrically connected to an anode of a diode D1 as shown in FIG. 6A. That is, in the lighting device 1 of the embodiment, a peak detection circuit 12 is configured to detect a fall (a trailing edge) of an anode voltage of the diode D1 as shown in FIG. 6B. The peak detection circuit 12 (controller 19) is configured to detect timing for turning on a switching device Q1 at a point in time at which energy discharge from a transformer T1 is finished, based on variation of an anode voltage of the diode D1.

An operation of the peak detection circuit 12 is briefly explained. When the switching device Q1 is in off-state, a DC voltage supplied from the microcomputer 4 becomes an output voltage of the peak detection circuit 12 until discharge of a secondary current flowing through the secondary and tertiary windings T12 and T13 of the transformer T1 is finished. If the anode voltage of the diode D1 decreases after the discharge of the secondary current is finished, the DC voltage supplied from the microcomputer 4 is pulled out via a diode D2. As a result, the output voltage of the peak detection circuit 12 decreases.

Figure 4D:
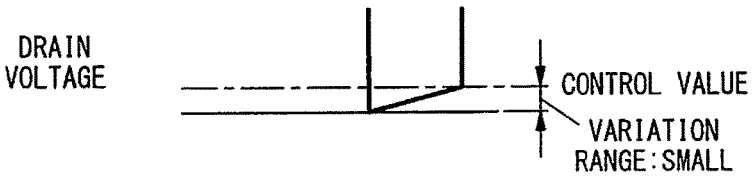

In the lighting device 100 of FIG. 2, when the power converter 300 has a low output voltage, a fall of a drain voltage of the switching device Q100 has a small variation range (a small decrease range) as shown in FIG. 4D. There is therefore a concern that the peak detection circuit 12 of the lighting device 100 cannot accurately detect timing when the drain voltage of the switching device Q100 decreases. That is, the concern is the lighting device 100 is hard to turn on the switching device Q100 at desired timing through the peak detection circuit 12 and cannot control the power converter 300 at a boundary current mode (i.e., cannot turn on the switching device Q100 at a point in time at which energy discharge from the transformer T100 is finished).

In the lighting device 1 of the embodiment, the peak detection circuit 12 is configured to detect the fall of the anode voltage of the diode D1 as described above. Therefore, in comparison with the lighting device 100, a voltage input to the peak detection circuit 12 in the lighting device 1 of the embodiment can have a large variation range even if a power converter 3 has a low output voltage. Therefore, the lighting device 1 of the embodiment can easily turn on the switching device Q1 at desired timing and stably control the power converter 3 at the boundary current mode.

The variation range of the anode voltage of the diode D1 can be made almost the same level as that of the output voltage of the power converter 3 by appropriately setting a turn ratio of the tertiary winding T13.

The lighting device 1 of the embodiment is configured so that timing for supplying a DC voltage from the microcomputer 4 to the peak detection circuit 12 is delayed by t1 from timing when the switching device Q1 is turned off. It is therefore possible to prevent a malfunction of the peak detection circuit 12 caused by a ringing phenomenon in the anode voltage of the diode D1 when the switching device Q1 is turned off.

Figure 7:
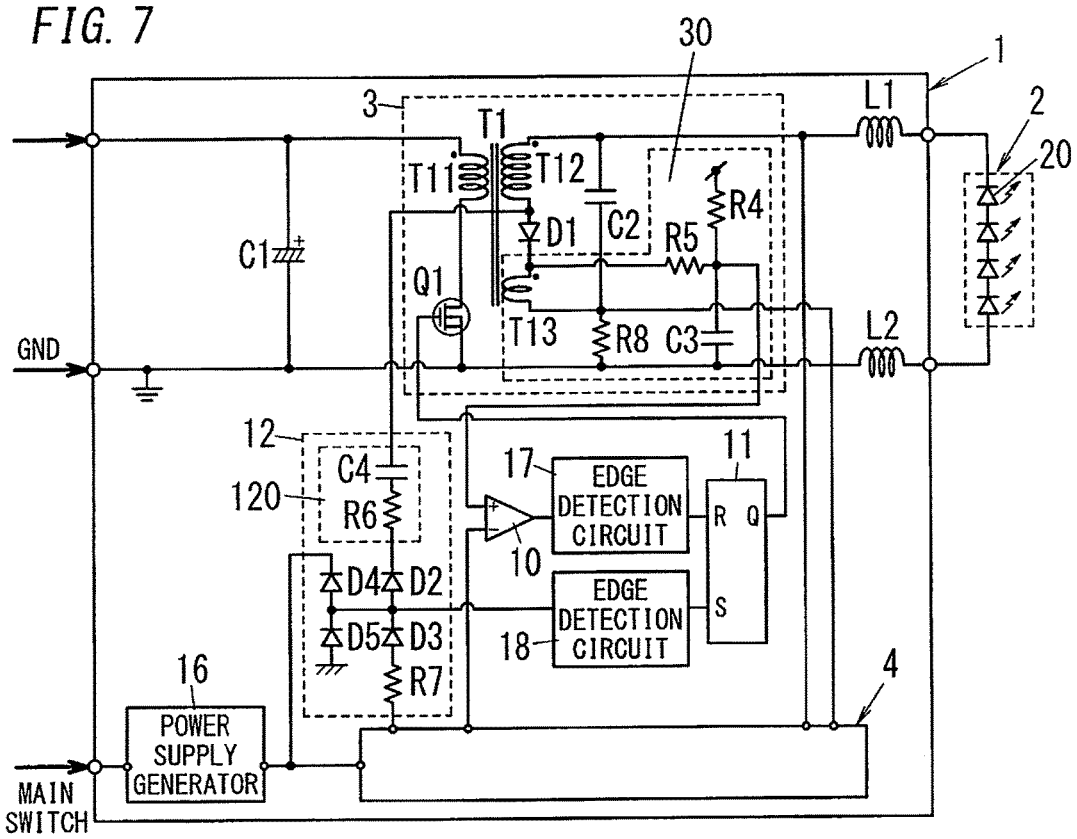
FIG. 7 is a circuit diagram showing another configuration of the lighting device.

In the lighting device 1 of the embodiment, a junction of the tertiary winding T13 and a capacitor C2 (an output capacitor) may be electrically connected to GND via a resistor R8 as shown in FIG. 7. In the configuration, when an output current of the power converter 3 suddenly decreases owing to variation of the load 2 or a power supply voltage of a battery 6, a voltage across the resistor R8 also decreases according the decreasing output current. As a result, an output voltage of the primary current sensor 30 is decreased, and it is accordingly possible to elongate a time until the output voltage of the primary current sensor 30 reaches a control value from the microcomputer 4, namely on-time of the switching device Q1.

When the output current of the power converter 3 is suddenly decreased, the microcomputer 4 can detect a decrease in the output current to increase the control value, but in this case a delay time of control cannot be avoided. That consequently causes a flicker in the load 2 because the delay time of control may promote variation in the output current of the power converter 3.

In the configuration of FIG. 7, it is possible to elongate on-time of the switching device Q1 by momentarily decreasing the output voltage of the primary current sensor 30 without relying on the microcomputer 4 when the output current of the power converter 3 is suddenly changed. A flicker in the load 2 can be prevented when a power supply voltage of the battery 6 or the load 2 suddenly changes.

Figure 8:
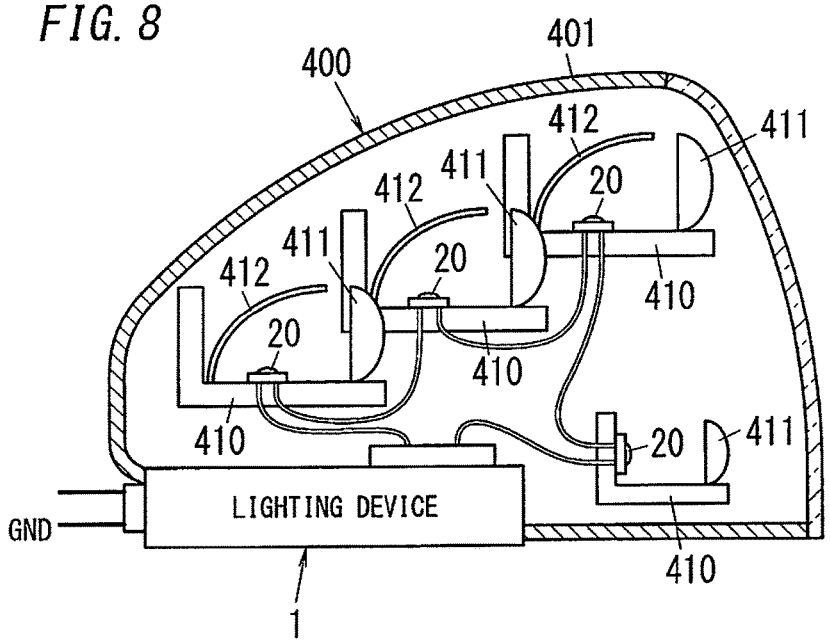
FIG. 8 illustrates a headlight device in accordance with an embodiment of the present invention.

A headlight device 400 of an embodiment is explained with reference to FIG. 8. As shown in FIG. 8, the headlight device 400 of the embodiment includes a lighting device 1 of any one of the aforementioned embodiments, a load 2 formed of two or more LEDs 20, and a housing 401 that houses the load 2. The LEDs 20 are attached to respective lamp bodies 410. Each of a part of the lamp bodies 410

(three lamp bodies 410 in FIG. 8) is provided with a lens 411 and a reflector 412. Remaining part of the lamp bodies 410 (one lamp body 410 in FIG. 8) is provided with only a lens 411 besides an LED 20.

A vehicle 500 of an embodiment is explained with reference to FIG. 9. The vehicle 500 of the embodiment is equipped with two headlight devices 400 as shown in FIG. 9. Lighting devices 1 of the headlight devices 400 are electrically connected to a low beam switch 501 provided at a driver's seat in the vehicle 500. Therefore, if the low beam switch 501 is turned on, low beams, i.e., the loads 2 of the headlight devices 400 are lit.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

The invention claimed is:

1. A lighting device, comprising:

a power converter that comprises a transformer comprising primary and secondary windings on input and output sides thereof, respectively, and a switching device that is electrically connected in series with the primary winding, the power converter being configured to perform conversion of a power supply voltage from a DC power supply to supply an output obtained by the conversion to a load formed of one or more light-emitting devices, and a controller configured to control ON and OFF of the switching device so as to adjust the output of the power converter, wherein the transformer further comprises a tertiary winding on the output side different from the secondary winding, and the controller is configured to a) detect a signal simulating a primary current flowing through the primary winding by measuring a voltage across a capacitor charged and discharged by a voltage occurring across the tertiary winding and b) turn the switching device off in response to the signal simulating the primary current crossing a threshold.

2. The lighting device of claim 1, further comprising a control power supply configured to supply an operation voltage to the controller, wherein the power converter comprises the capacitor configured to be discharged and charged by the voltage occurring across the tertiary winding, Hall the voltage across the capacitor being superposed with an offset voltage supplied from the control power supply, thereby simulating the primary current, and the controller is configured to measure the voltage across the capacitor that simulates the primary current.

3. The lighting device of claim 2, wherein the transformer is formed of an autotransformer, the switching device is electrically connected to a junction of the primary and secondary windings, and the controller is configured: to detect timing for turning on the switching device at a point in time at which energy discharge from the transformer is finished, based on variation of a voltage occurring across the switching device; and then to turn on the switching device in accordance with the timing for turning on the switching device.

4. The lighting device of claim 2, wherein the power converter comprises a diode electrically connected in series with the secondary winding, and the controller is configured: to detect timing for turning on the switching device at a point in time at which energy discharge from the transformer is finished, based on variation of a voltage occurring at one end of the diode; and then to turn on the switching device in accordance with the timing for turning on the switching device.

5. The lighting device of claim 4, wherein the diode of the power converter is electrically connected between the secondary and tertiary windings, the diode is arranged so as to prevent an electric current from flowing through the secondary and tertiary windings when the switching device is turned on, and the controller is configured to detect timing for turning on the switching device at a point in time at which energy discharge from the transformer is finished, based on variation of an anode voltage of the diode.

6. The lighting device of claim 5, wherein the power converter comprises an output capacitor configured to supply electric power to the load, and a junction of the tertiary winding and the output capacitor is electrically connected to ground via a resistor.

7. The lighting device of claim 1, wherein the transformer is formed of an autotransformer, the switching device is electrically connected to a junction of the primary and secondary windings, and the controller is configured: to detect timing for turning on the switching device at a point in time at which energy discharge from the transformer is finished, based on variation of a voltage occurring across the switching device; and then to turn on the switching device in accordance with the timing for turning on the switching device.

8. The lighting device of claim 1, wherein the power converter comprises a diode electrically connected in series with the secondary winding, and the controller is configured: to detect timing for turning on the switching device at a point in time at which energy discharge from the transformer is finished, based on variation of a voltage occurring at one end of the diode; and then to turn on the switching device in accordance with the timing for turning on the switching device.

9. The lighting device of claim 8, wherein the diode of the power converter is electrically connected between the secondary and tertiary windings, the diode is arranged so as to prevent an electric current from flowing through the secondary and tertiary windings when the switching device is turned on, and the controller is configured to detect timing for turning on the switching device at a point in time at which energy discharge from the transformer is finished, based on variation of an anode voltage of the diode.

10. The lighting device of claim 9, wherein the power converter comprises an output capacitor configured to supply electric power to the load, and a junction of the tertiary winding and the output capacitor is electrically connected to ground via a resistor.

11. A headlight device, comprising the lighting device and the load of claim 1, and a housing that houses the load.

12. A vehicle, comprising a headlight device that comprises a load formed of one or more light-emitting devices, a housing that houses the load, and a lighting device, wherein the lighting device comprises: a power converter that comprises a transformer comprising primary and secondary windings on input and output sides thereof, respectively, and a switching device that is electrically connected in series with the primary winding, the power converter being configured to perform conversion of a power supply voltage from a DC power supply to supply an output obtained by the conversion to a load formed of one or more light-emitting devices; and a controller configured to control ON and OFF of the switching device so as to adjust the output of the power converter, the transformer further comprises a tertiary winding on the output side different from the secondary winding, and the controller is configured to a) detect a signal simulating a primary current flowing through the primary winding by measuring a voltage across a capacitor charged and discharged by a voltage occurring across the tertiary winding and b) turn the switching device off in response to the signal simulating the primary current crossing a threshold.

* * * * *